United States Patent [19]

Darm

[11] 3,982,588

[45] Sept. 28, 1976

[54] GREASE-COLLECTING HEAT EXCHANGER INSTALLATION

[76] Inventor: William J. Darm, 5815 SW. Tucker, Beaverton, Oreg. 97005

[22] Filed: May 28, 1974

[21] Appl. No.: 473,512

Related U.S. Application Data

[60] Division of Ser. No. 252,909, May 12, 1972, Pat. No. 3,827,343, and a continuation-in-part of Ser. No. 468,659, May 10, 1974.

[52] U.S. Cl. ..... 165/165; 55/269; 98/115 K; 165/95; 165/166

[51] Int. Cl.[2] ..... F28D 9/02; F28F 3/00; F28G 1/16

[58] Field of Search ..... 165/47, 95, 166, 5, 165/165; 98/115 K; 55/269

[56] References Cited

UNITED STATES PATENTS

| | | | |
|---|---|---|---|
| 1,680,145 | 8/1928 | Forssblad | 165/95 |
| 1,786,182 | 12/1930 | Whiton, Jr. et al. | 165/95 |
| 1,894,026 | 1/1933 | Derry | 165/95 |
| 2,634,164 | 4/1953 | Drake | 165/95 |
| 3,260,189 | 7/1966 | Jensen | 98/115 K |
| 3,292,525 | 12/1966 | Jensen | 98/115 K |
| 3,371,709 | 3/1968 | Rosenblab | 165/165 |
| 3,616,744 | 11/1971 | Jensen | 98/115 K |
| 3,751,885 | 8/1973 | McNeely | 98/115 K |
| 3,827,343 | 8/1974 | Darm | 165/166 |

*Primary Examiner*—Albert W. Davis, Jr.
*Assistant Examiner*—Sheldon Richter
*Attorney, Agent, or Firm*—Klarquist, Sparkman, Campbell, Leigh, Hall & Whinston

[57] ABSTRACT

A heat exchanger with a set of channels through which grease laden air travels. Relatively cool air passes through the heat exchanger in a second set of channels. Washing means including liquid tubes within the first set of channels is provided for washing collected grease from the surfaces defining the first set of channels. A cooking facility including a hood for collecting grease laden air connected to a heat exchanger. Relatively cool air from an outside source passes through the heat exchanger to promote the collection of grease in the exchanges from the grease laden air received from the hood. The air from the outside source is raised in temperature on passing through the exchanger. Such heated air may be used as a source of heat for heating a building enclosure.

11 Claims, 2 Drawing Figures

GREASE-COLLECTING HEAT EXCHANGER INSTALLATION

REFERENCE TO RELATED APPLICATIONS

The present application is a division of copending application Ser. No. 252,909 filed May 12, 1972, now U.S. Pat. No. 3,827,343 and is a continuation in part of copending application Ser. No. 468,659 filed May 10, 1974.

BACKGROUND OF THE INVENTION

This invention relates generally to apparatus for removing grease from grease laden air, utilizing a heat exchanger for the collection by solidification of the grease.

In an embodiment of the invention, a cooking facility is contemplated, provided with a hood for collecting grease and contaminant laden air given off during the cooking process. Such is channeled through a set of exchanger channels in a heat exchanger, where grease in the air becomes deposited and solidifies on exchanger plates defining such channels. Cooler outside air is directed through another set of channels in the exchanger, and this outside air receives heat from the grease laden air, which may be utilized for the heating of the building which houses the cooking facility.

One object of the present invention is the provision of a heat exchanger utilized in the removal of grease and other contaminants from a moving mass of air. A further object is to provide within such exchanger a washing fluid dispenser means for washing the exchanger to cleanse it of the grease and other contaminants that collect on exchanger surfaces in the exchanger.

Other objects and advantages of the invention include improvements in a cooking facility including in combination with a hood an exchanger effective to remove efficiently and thoroughly grease and like components found in grease laden air, improvements in a cooking facility wherein the heat possessed by grease laden air which is normally discharged to the atmosphere is conserved by transferring such heat to make up air, and improvements in a heat exchanger characterized by means in the exchanger periodically for washing exchanger surfaces therein.

These and other objects and advantages are attained by the invention which will become fully apparent as the following description is read in conjunction with the accompanying drawings, wherein:

FIG. 1 illustrates, in diagrammatic and somewhat simplified form, a heat exchanger installation for a building enclosure, where the heat exchanger forms part of a cooking facility, according to one embodiment of the invention; and FIG. 2 is a perspective view illustrating in simplified form the interior of a heat exchanger and means for washing channels therein.

DESCRIPTION OF PREFERRED EMBODIMENT

Figure 1:
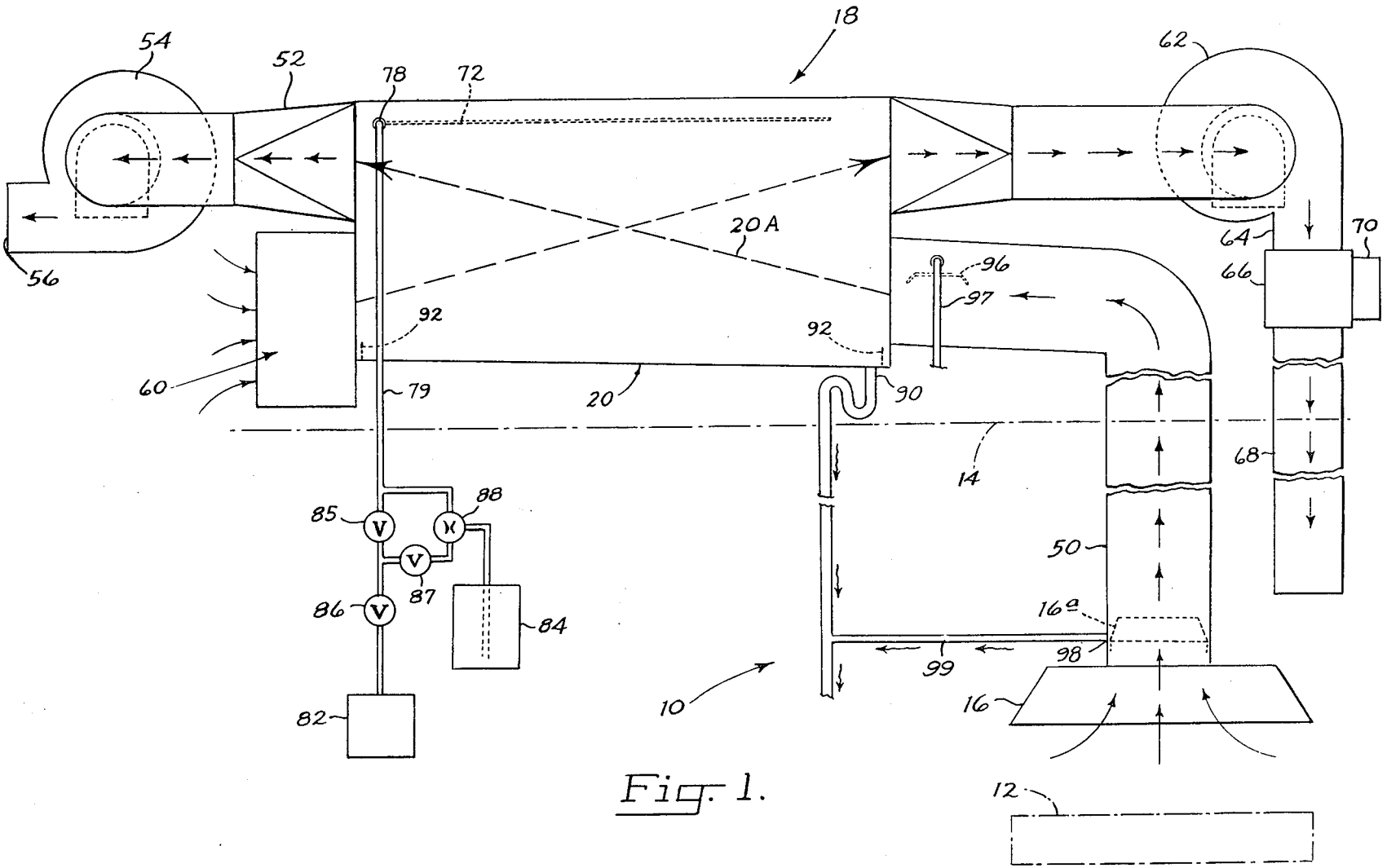

Referring now to the drawings, and first of all more particularly to FIG. 1, illustrated at 10 are portions of a cooking facility, such as might be provided in a restaurant or other dispenser of a large volume of prepared food. The cooking facility includes cooking means 12 for cooking the food prepared, which might take the form of burners, a hot plate, a fryer etc. Cooking means 12 is located in the kitchen of the restaurant, which kitchen is housed within a building enclosure, diagrammatically indicated in FIG. 1 by the dot-dash line 14, representing portions of the roof line of the building enclosure.

Disposed over cooking means 12 in position to receive air laden with grease and other contaminants normally produced as a result of the cooking process is hood means or assembly 16.

As contemplated by this invention, the grease laden air which passes up into hood means 16 thence is channeled through a heat exchanger shown at 18. The heat exchanger performs a number of functions, including the extraction of grease from the laden air prior to such air being exhausted to the atmosphere outside the building enclosure, and the transfer of the heat from the grease laden air to air flowing into the building enclosure from the outside, which inflowing air may be make-up air replacing that removed through the hood.

Further explaining, heat exchanger 18 comprises a substantially rectangular elongated housing 20. Within the housing are a series of heat exchanger plates, disposed substantially parallel to each other and extending along the length of the housing. The plates are laterally spaced from each other, and define multiple channels extending along the length of the housing. Alternate ones of these channels are utilized for the transfer of grease laden air through the exchanger. The channels interspersed with these alternate ones are utilized in the passage of inflowing relatively cool air, which may be used as make-up air.

Figure 2:
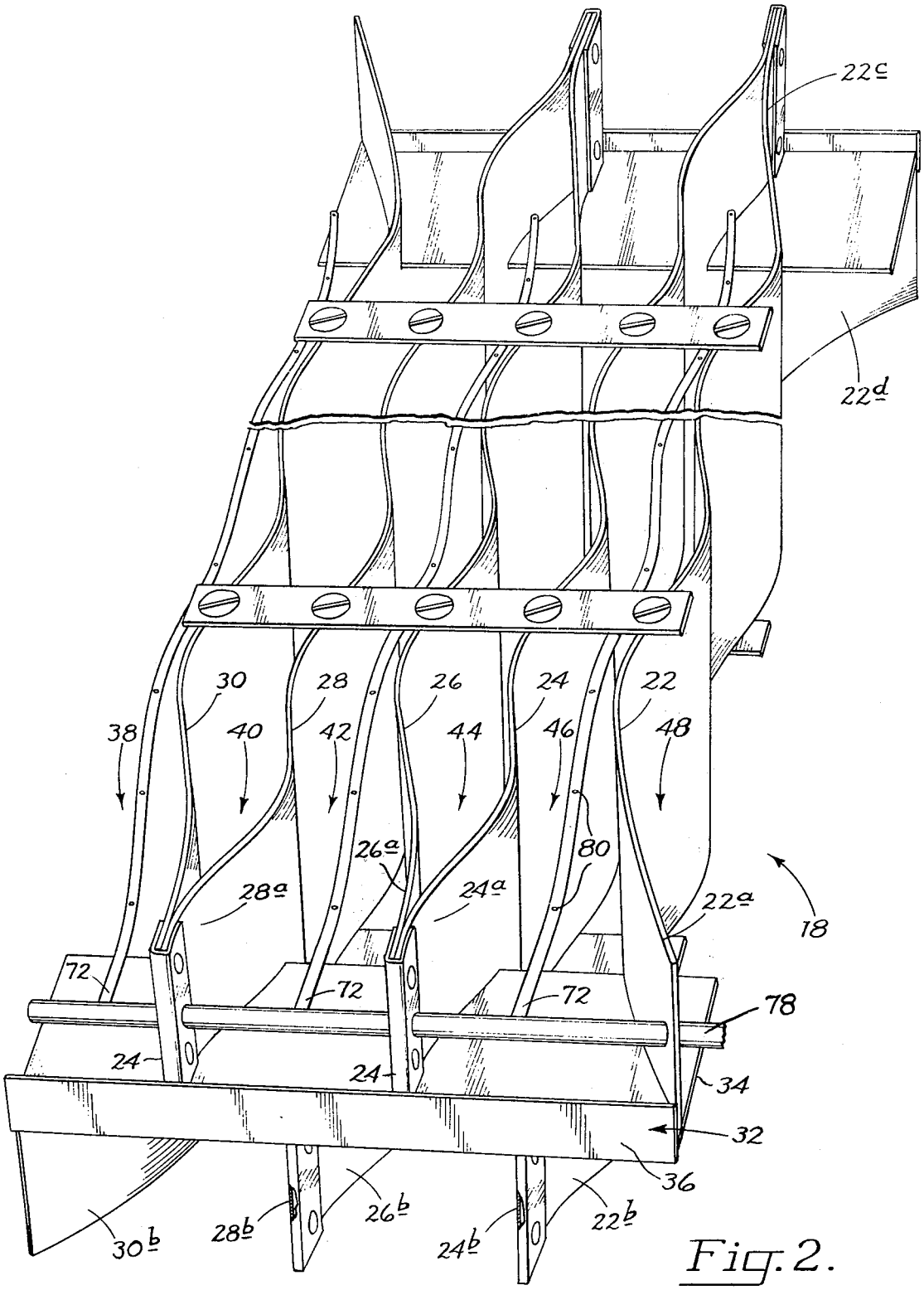

With reference to FIG. 2, here there is illustrated in simplified form an assembly of exchanger plates such as might be provided within the exchanger housing discussed. The assembly in simplified form includes five exchanger plates, illustrated at 22, 24, 26, 28 and 30. Each of the plates has a length substantially corresponding to the length of the exchanger housing in which the assembly is incorporated. The plates are shown provided with corrugations extending transversely of their length, whereby air passing through the heat exchanger is given a degree of turbulence and changes its direction of flow.

Each of the plates at each of its ends is split with a cut extending longitudinally of the plate. The cut parallels the longitudinal edges of the plate, and normally is made about midway between the longitudinal edges, thus to divide the end of each plate into a pair of tongue segments, exemplified by segments 22*a*, 22*b* in plate 22, of substantially equal width and length.

The tongue segments of each exchanger plate are shown bent in reverse direction. Thus, tongue segment 22*a* is bent to curve outwardly, where it may meet with the housing of the exchanger which surrounds the assembly, and tongue segment 22*b* below segment 22*a* is bent to curve inwardly. Considering exchanger plate 24, its upper tongue segment 24*a* is bent inwardly, whereas its lower tongue segment 24*b* is bent outwardly to meet with tongue segment 22*b*.

Where adjacent ends of tongue segments meet, they may be fixed together, using an overlying angle piece such as angle pieces 24 secured in place as by crimping.

It will be noted that whereas upper tongue segment 22*a* of plate 22 is bent outwardly and the lower one 22*b* is bent inwardly, at the opposite end of the exchanger plate assembly upper tongue segment 22*c* is bent inwardly whereas the lower one 22*d* is bent outwardly. This same relationship holds true for the tongue segments at each set of ends of an exchanger plate.

A divider means shown at 32 including a horizontal wall expanse 34 and a vertical marginal flange 36 may be inserted into cuts forming the tongue segments, at each set of ends of the exchanger plates in the assembly. The divider member when positioned as shown in FIG. 2, serves to separate end portions of channels defined on opposite sides of the various plates. Thus, and considering channel 42, the divider separates this channel, where such is defined between tongue segments 28*a* and 26*a*, from portions of channels 40 and 44 below the divider, defined between tongue segments 30*b*, 28*b* and 26*b*, 24*b*, respectively.

As shown in FIG. 2, channels 38, 42, and 46, at the end of the plate assembly pictured at the bottom of the figure, open to the end of the assembly above the divider. At the opposite end of the assembly, these channels open up to the end of the assembly below the divider. The reverse is true for channels 40, 44 and 48, which at the assembly pictured at the bottom of the figure open to the end of the assembly below the divider, and at the opposite end of the assembly open to the end of the assembly above the divider.

With the construction described, and assuming the presence of an encompassing housing 20, it should be obvious that one set of channels may be utilized for the passage of one body of gas through the exchanger, and an alternating set of channels may be utilized for the passage of another volume of gas through the exchanger, with such bodies of gas passing through multiple flow paths interspersed with each other.

Referring again to FIG. 1, hood means 16 includes a frusto conically shaped flange 16*a* at the top thereof forming an opening at the top of the hood. Secured to the hood and communicating with this opening is a conduit or duct 50. The opposite end of the duct joins with the lower part of exchanger housing 20 at the right end of the exchanger in FIG. 1. This places the interior of duct 50 in communication with the set of channels within the heat exchanger which open up to the bottom of the housing below divider member 32 at the right end of the exchanger.

It will be remembered from the description of the exchanger plate assembly set forth above, that the channels that open up to the bottom of the assembly at one end of the assembly open up to the top of the assembly at the opposite end of the assembly. Thus, the channels within the heat exchanger which communicate with duct 50, at the opposite end of the exchanger communicate with a duct 52 connecting with the upper end of the exchanger. Duct 52 is provided with a suitable motor-driven fan in a blower assembly 54, and an exhaust or outlet 56 located above the roof of building enclosure 14. Running of the blower assembly is operable to produce a flow of air through the exchanger in the direction of exhaust 56 indicated by the arrow 20A in FIG. 1.

Air which is withdrawn from the kitchen area customarily is at a relatively high temperature, having been warmed by the instrumentalities provided in the kitchen for the cooking of food. As contemplated by this invention, the heat of this expelled air is utilized to raise the temperature of a counterflowing mass of air, this air being usable, for instance, as make-up air for the building enclosure where the kitchen is located.

Referring to FIG. 1 a conventional filter assembly is designated at 60. The assembly includes the usual filtering material which functions to filter air moving into the assembly from the left of the filter assembly as pictured in FIG. 1. The outlet from the filter assembly communicates with the lower part of the heat exchanger at the left end of the exchanger in FIG. 1. Air drawn through the filter, therefore, passes into the heat exchanger into the set of channels which open to the bottom of the exchanger at the left end in FIG. 1.

These same channels, which are interspersed with the channels carrying the grease laden air, open up to the top of the exchanger at the right end of the exchanger in FIG. 1. Shown at 62 is a blower assembly including a fan having an inlet opening connecting with these channels at the top right hand end of the exchanger. Connecting with the exhaust from the blower assembly is a duct 64 joining with a valve assembly 66 leading to a pair of ducts 68, 70. Duct 70, for instance, may lead to the exterior of the building, whereas duct 68 may lead to the building's interior to provide a source of make-up air in the building. Valve assembly 66 is provided to control the proportion of air flowing through duct 64 which enters duct 70. This control is important, for instance, in enabling a greater flow of air through this return duct 68 under wintertime conditions, when maximum heating is desired, with a lesser flow under more moderate conditions, when the need for heated air is diminished. With running of blower assembly 62, the flow of filtered atmospheric air through the exchanger is in the direction indicated by arrow 20B in FIG. 1.

Referring again to FIG. 1, extending along each of the channels carrying the grease laden air in the exchanger, is an elongated conduit or tube 72. A manifold 78 connects together one set of ends of these tubes. The opposite ends of these tubes are closed off.

The tubes and manifold have been shown in FIG. 2, to illustrate with greater clarity how the tubes may be incorporated in the heat exchanger with such extending along the various channels defined between the exchanger plates. It will be noted that distributed along the top of each tube is a series of outlets 80.

As illustrated schematically in FIG. 1, the manifold is connected by pipe 79 to a source of hot water or other wash fluid 82, such as steam. Valve 86 controls the admission of such hot water to the manifold and tubes. A detergent supply, for introducing detergent to the water flowing to the tubes, is shown at 84. Valves 85, 87, and venturi device 88 are provided for controlling the amount of detergent withdrawn from supply 84 and introduced to the wash water flowing in conduit 79.

The tubes and manifold, and related structure, constitute a wash fluid dispensing system or means provided to enable periodic cleaning of the exchanger, more particularly those surfaces defining the channels which carry grease laden air from the hood assembly. The outlets in the tubes, which are distributed along the tops of the tubes, eject hot water into these channels, with such impinging upon the upper wall of the housing and cascading down the heat exchanger surfaces defining the sides of the channels. Cleaning of the heat exchanger reduces fire hazard, and promotes the efficiency of the heat exchanger.

As can be seen in FIG. 1, the heat exchanger is mounted in the installation with the base of the exchanger housing (which forms the floor defining the bottom of the channels described) sloping from left to right in the figure. This floor functions as a drain surface for those channels which are subjected to washing periodically. A drain is shown at 90 which receives water collecting at the bottom of the heat exchanger housing and flowing along this drain surface. The housing may have adjacent its opposite ends, and extending up from the floor of the housing, flanges such as depicted at 92, inhibiting the flow of water out from the ends of the housing.

Duct 50 leading from the hood assembly and connecting with the heat exchanger may also be provided with a wash system. Thus, illustrated in FIG. 1 is a rotatable sprinkling-type dispenser 96 operable to direct wash water about the interior of the duct. Conduit 97 supplying wash water to dispenser 96 may be connected in a suitable manner to pipe or conduit 79 supplying wash water to the tubes in the exchanger. In draining from the duct, the water flows down inner surfaces of the duct to collect on the outer side of frusto-conical flange 16*a*. At the base of the space defined between this flange and duct 50 is a drain 98, connected by conduit 99 to drain tube 90 providing for the flow of wash water outside the system.

During operation of the kitchen facility described, the grease and contaminant laden air coming from the grill, burner, fire or other cooking means, travels upwardly into the hood assembly and through a set of channels in the heat exchanger, as the result of the suction produced by operation of fan assembly 54, with such air ultimately being ejected into the atmosphere outside the enclosure. On traveling through the heat exchanger, the grease and contaminants contained in the air collect on the surfaces of the exchanger plates defining the channels through which the grease laden air travels. The exchanger plates, by reason of their relatively cool state, promote condensation and solidification of the grease and thus separation of the grease from the moving mass of air.

The heat from the air which is withdrawn through the hood is transferred to the inflowing air passing through the exchanger. As a result, the make-up air is warmed without the use of energy from another energy source. The incoming air is filtered, and obtained from the atmosphere at a point remote from exhaust 56. Thus, it is odor free and clean.

Periodic cleaning of the heat exchanger and duct 50 is easily performed utilizing the water dispensing system described. With cleaning, the efficiency of the heat exchanger is returned to its maximum, and collections of grease, etc. which constitute a fire hazard are removed.

It should be obvious that the apparatus disclosed has a number of advantages. It is appreciated that various changes and variations may be made in the construction. It is desired to cover all such changes and variations as are embraced within the invention as set forth herein.

It is claimed and desired to secure by Letters Patent:

1. A heat exchanger apparatus comprising:

a heat exchanger having first passage means and second passage means within said exchanger which are disposed in heat-exchanging relationship on opposite sides of heat exchanger plates, said plates having their ends split into two end portions which are joined to different exchanger plates on opposite sides thereof to form said first and second passage means;

means for transmitting air streams of different temperatures through said first and second passage means to cause a heat exchange between said air streams; and liquid dispensing means for dispensing liquid into one of said first and second passage means.

2. A heat exchanger apparatus in accordance with claim 1 in which the liquid dispensing means includes a water sprayer means provided within the heat exchanger.

3. A heat exchanger apparatus in accordance with claim 2 in which the water sprayer means includes a plurality of nozzle means mounted within the passage means.

4. A heat exchanger apparatus in accordance with claim 1 in which a divider member extends between the two end portions of each split end of the heat exchanger plates to separate the first and second passage means.

5. A heat exchanger apparatus comprising:

a heat exchanger having first and second passage means within said heat exchanger and disposed in heat-exchanging relationship on opposite sides of heat exchanger plates which separate said first and second passage means, said plates having their ends split into two end portions which are joined to different exchanger plates on opposite sides thereto to form said first and second passage means;

first means for exhausting relatively hot, contaminant laden air through said first passage means;

second means for transmitting relatively cool air through said second passage means to cool the contaminant laden air and thereby cause contaminants in said laden air to be deposited onto the surfaces of said first passage means; and removal means for removing the deposited contaminants out of said first passage means.

6. A heat exchanger apparatus in accordance with claim 5 in which a divider member extends between the two end portions of each split end of the heat exchanger plates to separate the first and second passage means.

7. A heat exchanger apparatus in accordance with claim 5 in which the first and second means cause the laden air and the cool air to flow in opposite directions along the heat exchanger plates.

8. A heat exchanger apparatus in accordance with claim 5 in which the second means cools the heat exchanger plates sufficiently to cause the contaminants to condense on the surfaces of said plates within said first passage means and thereby separate said contaminant from the laden air.

9. A heat exchanger apparatus in accordance with claim 5 in which the removal means includes a washing fluid dispensing means.

10. A heat exchanger apparatus in accordance with claim 9 in which the fluid dispensing means is mounted within the heat exchanger.

11. A heat exchanger apparatus in accordance with claim 10 in which the fluid dispensing means includes a plurality of nozzles which are mounted within the first passage means.

* * * * *

UNITED STATES PATENT AND TRADEMARK OFFICE

CERTIFICATE OF CORRECTION

PATENT NO. : 3,982,588

DATED : September 28, 1976

INVENTOR(S) : William J. Darm

It is certified that error appears in the above-identified patent and that said Letters Patent are hereby corrected as shown below:

Column 6, line 28, claim 5, "thereto" should be --thereof--.

Column 1, line 48, insert --more-- between "become" and "fully".

Column 3, line 1, "means" should be --member--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*